US006128980A

United States Patent [19]

Hu

[11] Patent Number: 6,128,980

[45] Date of Patent: Oct. 10, 2000

[54] OPTIMAL CLEARANCE RETAINING DEVICES FOR ADJUSTABLE WRENCHES

[76] Inventor: Bobby Hu, P.O. Box 63-247, Taichung, Taiwan

[21] Appl. No.: 09/217,522

[22] Filed: Dec. 21, 1998

[51] Int. Cl.[7] ..... B25B 13/16

[52] U.S. Cl. ..... 81/170; 81/133; 81/165

[58] Field of Search ..... 81/133–140, 142–145, 81/165, 170–172

[56] References Cited

U.S. PATENT DOCUMENTS

| | | | |
|---|---|---|---|
| 1,512,846 | 10/1924 | Gumprecht | 81/165 |
| 2,483,917 | 10/1949 | Maselter | 81/165 |
| 2,648,243 | 8/1953 | Chappel | 81/165 |
| 2,755,693 | 7/1956 | Hund | 81/165 |
| 2,780,124 | 2/1957 | Lyons | 81/165 |
| 2,808,751 | 10/1957 | Fercand | 81/165 |
| 2,913,942 | 11/1959 | Rozmus | 81/165 |
| 4,094,215 | 6/1978 | Hudson | 81/133 X |
| 5,154,103 | 10/1992 | Lewis, Jr. | 81/165 |
| 5,209,144 | 5/1993 | LuGuoji | 81/165 |

*Primary Examiner*—D. S. Meislin

*Attorney, Agent, or Firm*—Alan Kamrath; Oppenheimer Wolff & Donnelly LLP

[57] ABSTRACT

An adjustable wrench includes a handle, a head connected to the handle and including a fixed jaw formed thereon and a movable jaw mounted thereon, an adjusting screw rotatably mounted in a web area between the handle and the head for moving the movable jaw relative to the fixed jaw, and a clearance retaining device including an actuating member, a braking wheel, and a retaining member. The actuating member includes an end connected to an axle to which the adjusting screw is mounted. The braking wheel is normally in a free position not engaged with the adjusting screw when the actuating member is in a first position. When the actuating member is moved to a second position for fine adjustment, the braking wheel is moved and rotated to cause the adjusting screw to rotate through a predetermined angle such that the movable jaw is slightly moved away from the fixed jaw for a pre-determined distance. The braking wheel is retained between the adjusting screw and the retaining member after such fine adjustment.

20 Claims, 7 Drawing Sheets

OPTIMAL CLEARANCE RETAINING DEVICES FOR ADJUSTABLE WRENCHES

BACKGROUND OF THE INVENTION

1. Field of the Invention

The present invention relates to clearance retaining devices that may assure an optimal clearance between a movable jaw of an adjustable wrench and an article held between the movable jaw and the fixed jaw.

2. Description of the Related Art

FIG. 9 illustrates a typical adjustable wrench that has a fixed jaw 12' and a movable jaw 13'. When driving a nut (not shown), the adjusting screw 14' is rotated until the space between the jaws 12' and 13' is capable of receiving the nut. Next, the movable jaw 13' is moved toward the fixed jaw 12' to tightly clamp the nut. Typically, an end wall of the movable jaw 13' generally has an angle $\alpha$ (about 0.5°) to a plane that is parallel to an inner wall of the fixed jaw 12'. Nevertheless, in order to allow easy disengagement of the adjustable wrench and the nut, the user generally has to proceed with minor adjustment by means of rotating the adjusting screw 14' again to move the movable jaw 13' slightly away from the fixed jaw 12' to thereby obtain an optimal clearance. However, such minor adjustment is difficult to achieve. The faces or edges of the nut will be damaged if the minor adjustment goes too far. To the contrary, it is difficult to disengage the adjustable wrench from the nut if the minor adjustment is not enough. In addition, the movable jaw 13' and the adjusting screw 14', even if the minor adjustment is achieved, will be moved upon repeated operation of the adjustable wrench on the nut. Furthermore, the adjusting screw 14' might be inadvertently impinged by the user's fingers or any articles and thus causes a change in the clearance. As a result, there is a high risk of damage to the nut. Use of adjustable wrenches is even prohibited in certain cases.

It is therefore a long and unfulfilled need in the adjustable wrench with a clearance retaining device to reliably retain the adjustable wrench in an optimal clearance.

SUMMARY OF THE INVENTION

It is a primary object of the present invention to provide an adjustable wrench with a retaining device to assure an optimal clearance between the movable jaw and the nut.

In accordance with a first aspect the present invention, an adjustable wrench comprises:

a handle;

a head connected to the handle and including a fixed jaw formed thereon and a movable jaw mounted thereon;

an adjusting screw rotatably mounted in a web area between the handle and the head by an axle for moving the movable jaw relative to the fixed jaw upon rotational movement of the adjusting screw; and a clearance retaining device including an actuating member having a first end connected to the axle and a second end, a braking wheel rotatably mounted to the actuating member at a position adjacent to the second end of the actuating member, and a retaining member, the braking wheel being releasably engaged with the adjusting screw and movable between a first position and a retained position, the actuating member being movable between a first position and a second position;

wherein the braking wheel is normally in the free position not engaged with the adjusting screw when the actuating member is in the first position, and when the braking wheel is moved to the retained position when the actuating member is moved to the second position, the adjusting screw is rotated through a pre-determined angle such that the movable jaw is slightly moved away from the fixed jaw for a pre-determined distance, and the braking wheel is retained in the retained position between the adjusting screw and the retaining member.

The web area includes a chamber defined therein for receiving the clearance retaining device.

The adjusting screw includes an anti-skid surface, and the braking wheel includes a braking surface for engaging with the anti-skid surface of the adjusting screw.

In an embodiment of the invention, the first end of the actuating member is open, and the actuating member includes two lateral walls having aligned holes adjacent to the open first end. The axle is extended through the aligned holes in a manner that the adjusting screw is located between the lateral walls of the actuating member. The lateral walls of the actuating member includes aligned holes adjacent to the second end of the actuating member. A pin is extended through the aligned holes, and the braking wheel is rotatably mounted around the pin that has a diameter smaller than that of the aligned holes.

An elastic member is mounted in the retaining member for biasing the actuating member to the first position.

In a preferred embodiment of the invention, the retaining member includes a first end distal to the adjusting screw, a second end adjacent to the adjusting screw, and a mediate section secured to the web area. An elastic member is mounted between the mediate section of the retaining member and the second end of the actuating member for biasing the actuating member to the first position. The first end of the retaining member includes a stop for restraining movement of the second end of the actuating member, thereby retaining the actuating member in the first position. The braking wheel is retained between the second end of the retaining member and the adjusting screw when in the retained position.

In accordance with a further aspect of the invention, an adjustable wrench comprises:

a handle;

a head connected to the handle and including a fixed jaw formed thereon and a movable jaw mounted thereon;

an adjusting screw rotatably mounted in a web area between the handle and the head by ax axle for moving the movable jaw relative to the fixed jaw upon rotational movement of the adjusting screw; and a clearance retaining device including an actuating member and a base, the actuating member having a first end adjacent to the adjusting screw, a second end distal to the adjusting screw, and a retaining element formed adjacent to the second end, the base including an end wall with a notch, the first end of the actuating member being connected to the axle and including a hole through which the axle is extended, the hole having a diameter greater than that of the axle, the retaining element being releasably engaged with the adjusting screw and movable between a first free position and a second retained position;

wherein the retaining element is normally in the first free position not engaged with the adjusting screw, and when the retaining element is moved to the second retained position, the adjusting screw is rotated through a pre-determined angle such that the movable jaw is slightly moved away from the fixed jaw for a pre-determined distance, and the second end of the actuating member is retained in the notch of the base.

An elastic member is mounted in the base for biasing the retaining element to the first free position.

The end wall of the base includes a stop for restraining movement of the second end of the actuating member, thereby retaining the retaining element in the free position.

The adjustable wrenches in accordance with the present invention allow easy, rapid fine adjustment to obtain an optimal clearance for operation, and such fine adjustment can be easily accomplished by a layman. In addition, damage to nuts or the like operated by the adjustable wrench is prevented. Furthermore, the optimal clearance can be repeatedly obtained and reliably retained while allowing easy disengagement of the nuts and the adjustable wrench.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
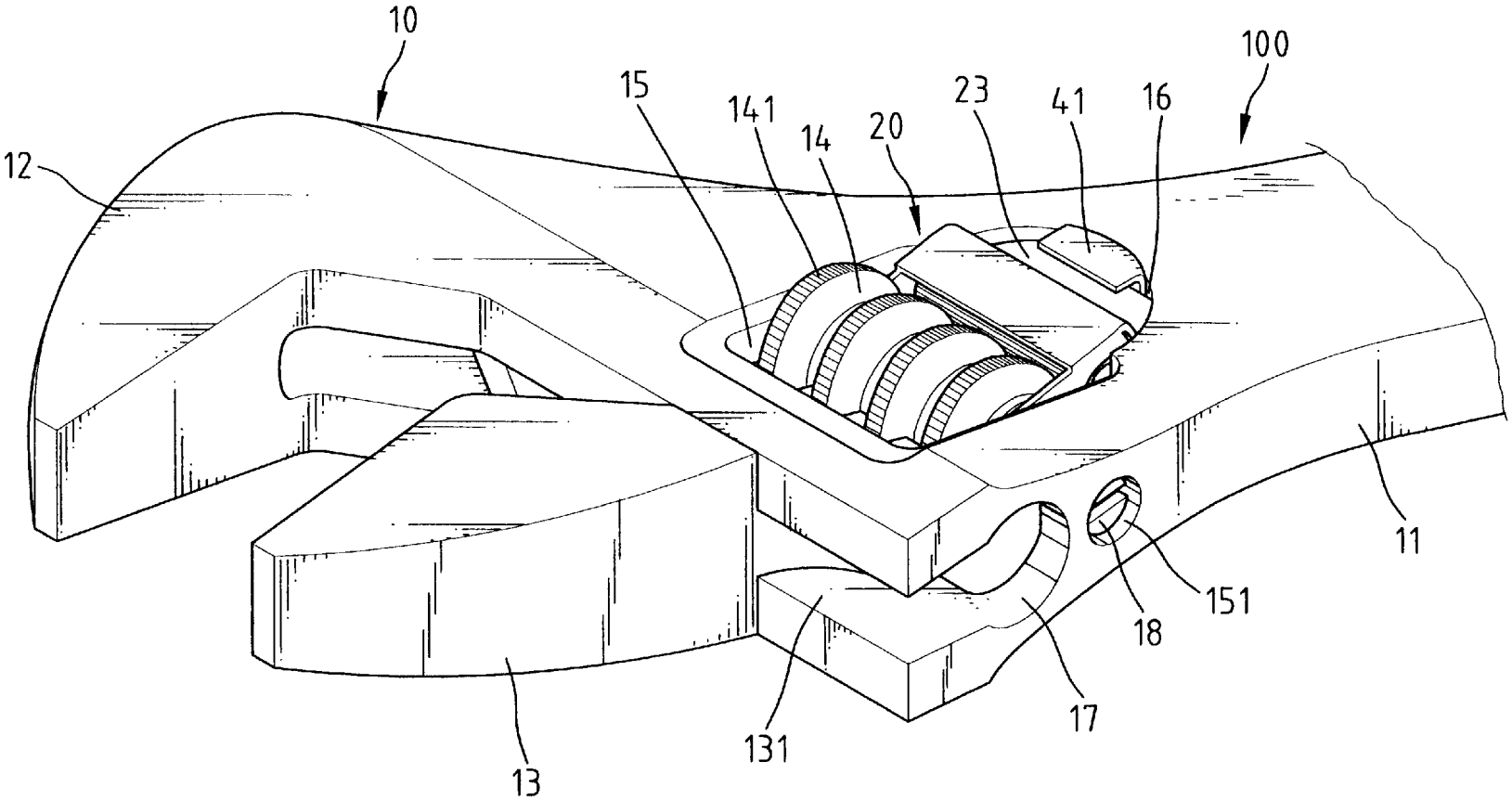
FIG. 1 is a partial perspective view illustrating a head portion of a first embodiment of an adjustable wrench in accordance with the present invention.
Figure 2:
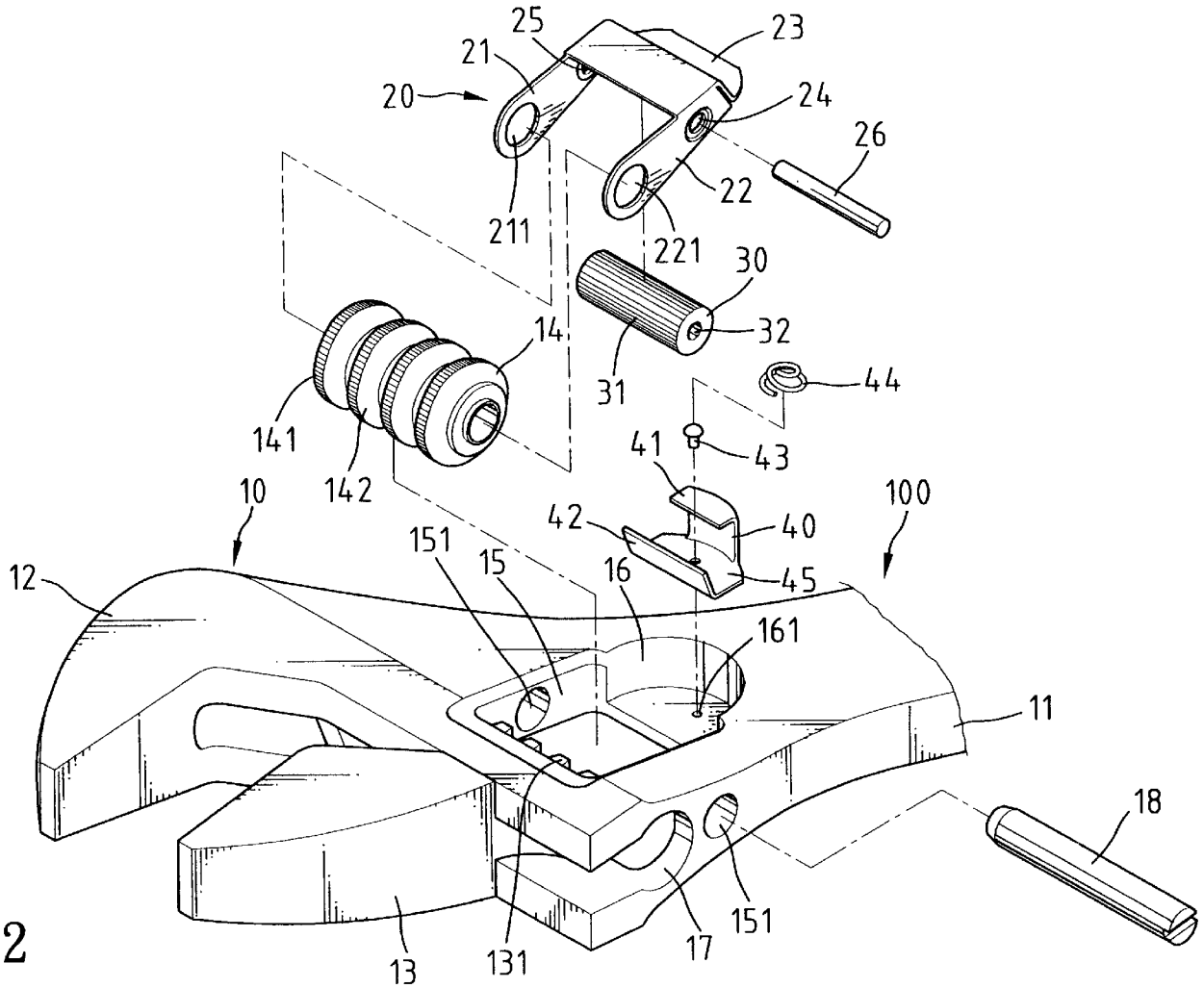
FIG. 2 is an exploded perspective view of the adjustable wrench in FIG. 1.
Figure 3:
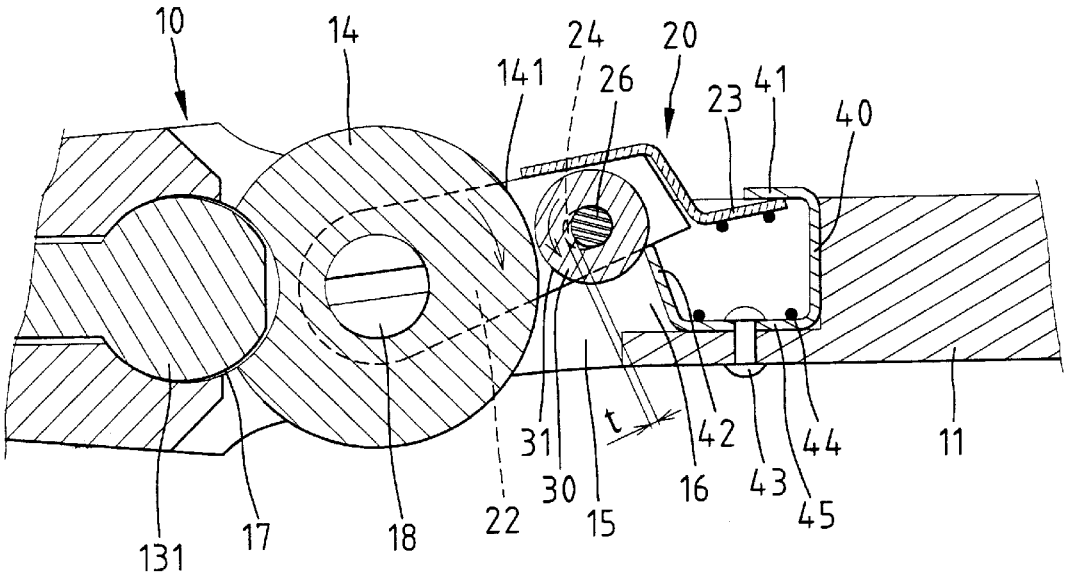
FIG. 3 is a partial sectional view of the adjustable wrench in FIG. 1, wherein an optimal clearance retaining plate is not pressed.

Referring to the drawings and initially to FIGS. 1 and 2, a first embodiment of an adjustable wrench 100 in accordance with the present invention generally includes a handle 11 and a head 10. The head 10 includes a fixed jaw 12, a movable jaw 13, and a channel 17 for guiding rectilinear movement of the movable jaw 13 relative to the fixed jaw 12. Interconnected between the handle 11 and the head 10 is a web area (not labeled) that includes a compartment 15 for rotatably receiving an adjusting screw 14. The web area further includes a chamber 16 communicated with the compartment 15, which will be described later. In this embodiment, the adjusting screw 14 is rotatably mounted to an axle 18 that is securely mounted in a hole 151 that aligns with the compartment 15, thereby allowing the adjusting screw 14 to rotate freely in the compartment 15. The adjusting screw 14 includes a helical groove 142 and an anti-skid surface 141 formed on a peak thereof. Referring to FIG. 3, the movable jaw 13 includes an end 131 received in the helical groove 142, whereby rotational movements of the adjusting screw 14 cause rectilinear movements of the movable jaw 13 relative to the fixed jaw 12, which is conventional and therefore not further described.

Referring to FIGS. 1 to 3, an optimal clearance retaining device is mounted in the chamber 16 and includes an actuating member 20, a retainer 40, an elastic member 44, and a braking wheel 30. As shown in FIGS. 2 and 3, the actuating member 20 includes a first open end, two spaced lateral walls 21 and 22, and a second end 23. The lateral walls 21 and 22 have aligned holes 211 and 221 adjacent to the first end of the actuating member 20 and through which the axle 18 is extended. The lateral walls 21 and 22 further have aligned holes 24 and 25 adjacent to the second end .23 of the actuating member 20 and through which a pin 26 is extended. It is noted that the diameter of the pin 26 is smaller than that of the holes 24 and 25 by "t". The braking wheel 30 includes a braking surface 31 and an axial hole 32 through which the pin 26 is extended. Thus, the braking wheel 30 is rotatably mounted between the lateral walls 21 and 22 of the actuating member 20. The retainer 40 includes a mediate section 45 that is secured in the chamber 16 by a rivet 43 extending through a hole 161 formed in the web area of the head 10. The retainer 40 further includes a first end 41 distal to the braking wheel 30 and a second end 42 adjacent to the braking wheel 30. The elastic member 44 is mounted between the mediate section 45 of the retainer 40 and the second end 23 of the actuating member 20. The elastic member 44 biases the braking wheel 30 away from the adjusting screw 14.

Figure 4:
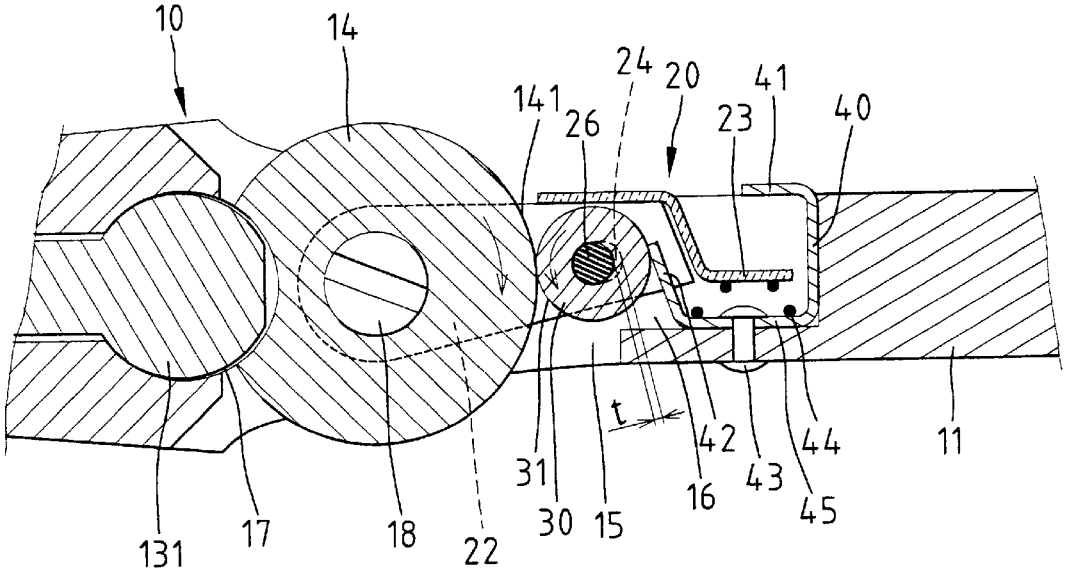
FIG. 4 is a sectional view similar to FIG. 3, wherein the optimal clearance retaining plate is pressed.
Figure 5:
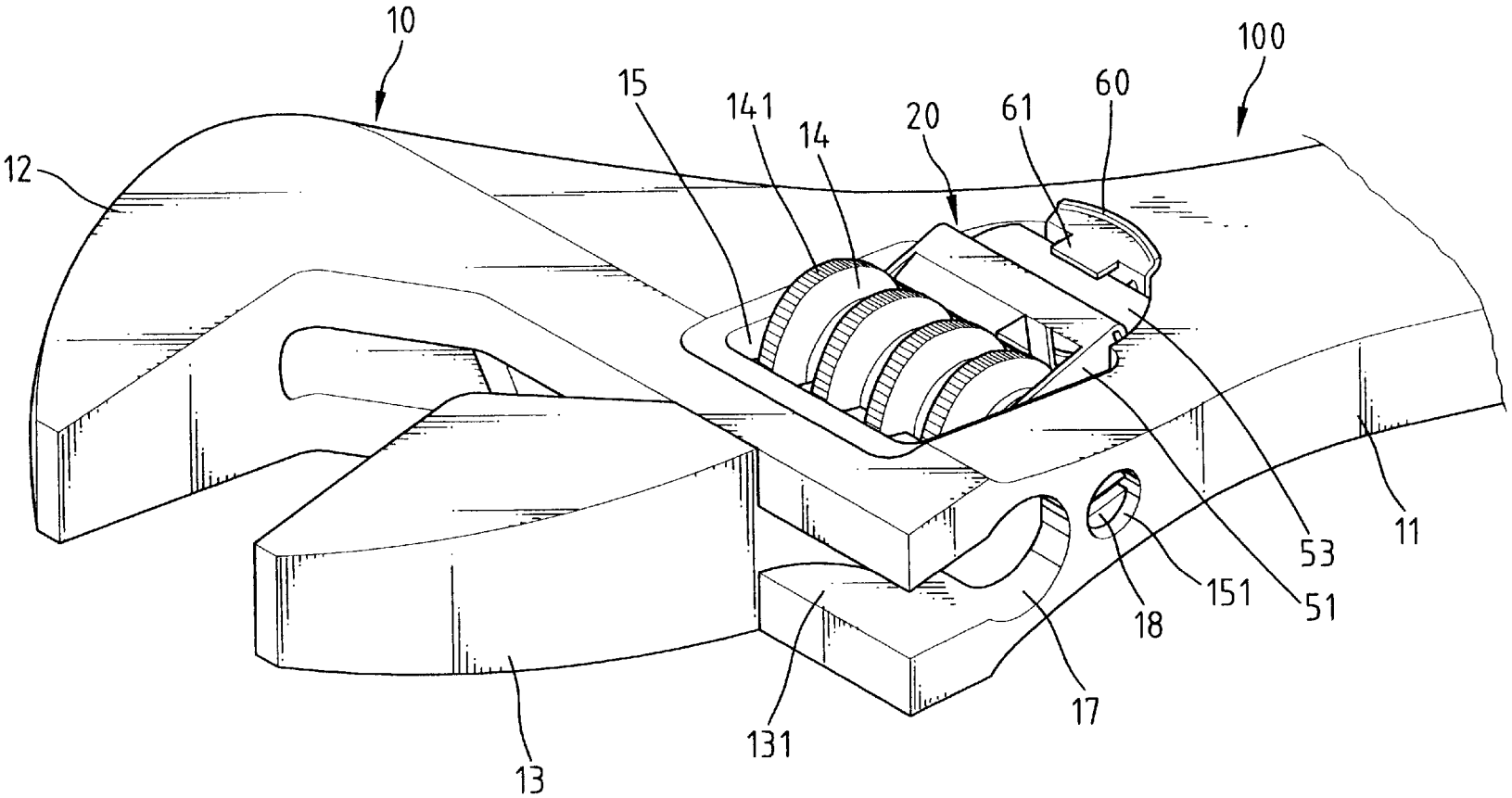
FIG. 5 is a partial perspective view illustrating a head portion of a second embodiment of an adjustable wrench in accordance with the present invention.

In use, the user may clamp a nut (not shown) between the fixed jaw 12 and the movable jaw 13 by means of conventional operational procedure before fine adjustment. If the nut has been tightly clamped between the fixed jaw 12 and the movable jaw 13 (FIG. 3), the user may manually press the actuating member 20 downwardly such that the braking wheel 30 displaces a distance of "t" and rotates in a direction, e.g., counterclockwise. As shown in FIG. 4, the braking surface 31 of the braking wheel 30 is moved to engage with the anti-skid surface 141 of the adjusting screw 14 and thus urges the adjusting screw 14 to rotate in another direction, e.g., clockwise. As a result, the adjusting screw 14 is moved through a pre-determined angle such that the movable jaw 13 is slightly moved away from the fixed jaw 12. As a result, the movable jaw 13 has a pre-determined clearance to the nut. In addition, the braking wheel 30 is retained between the second end 42 of the retainer 40 and the adjusting screw 14 after such fine adjustment, best shown in FIG. 4. Thus, a reliable optimal clearance can be repeatedly obtained by the adjustable wrench in accordance with the present invention. Such optimal clearance avoids damage to the faces or edges of the nut and allows easy disengagement of the adjustable spanner from the nut. In addition, the optimal clearance can be kept during use of the adjustable wrench. After use, the user may rotate the adjusting screw 14 in a reverse direction to release the braking wheel 30 from the second end 42 of the retainer 40. The actuating member 20 is returned to its initial free position shown in FIG. 3 under the action of the elastic member 44.

Figure 6:
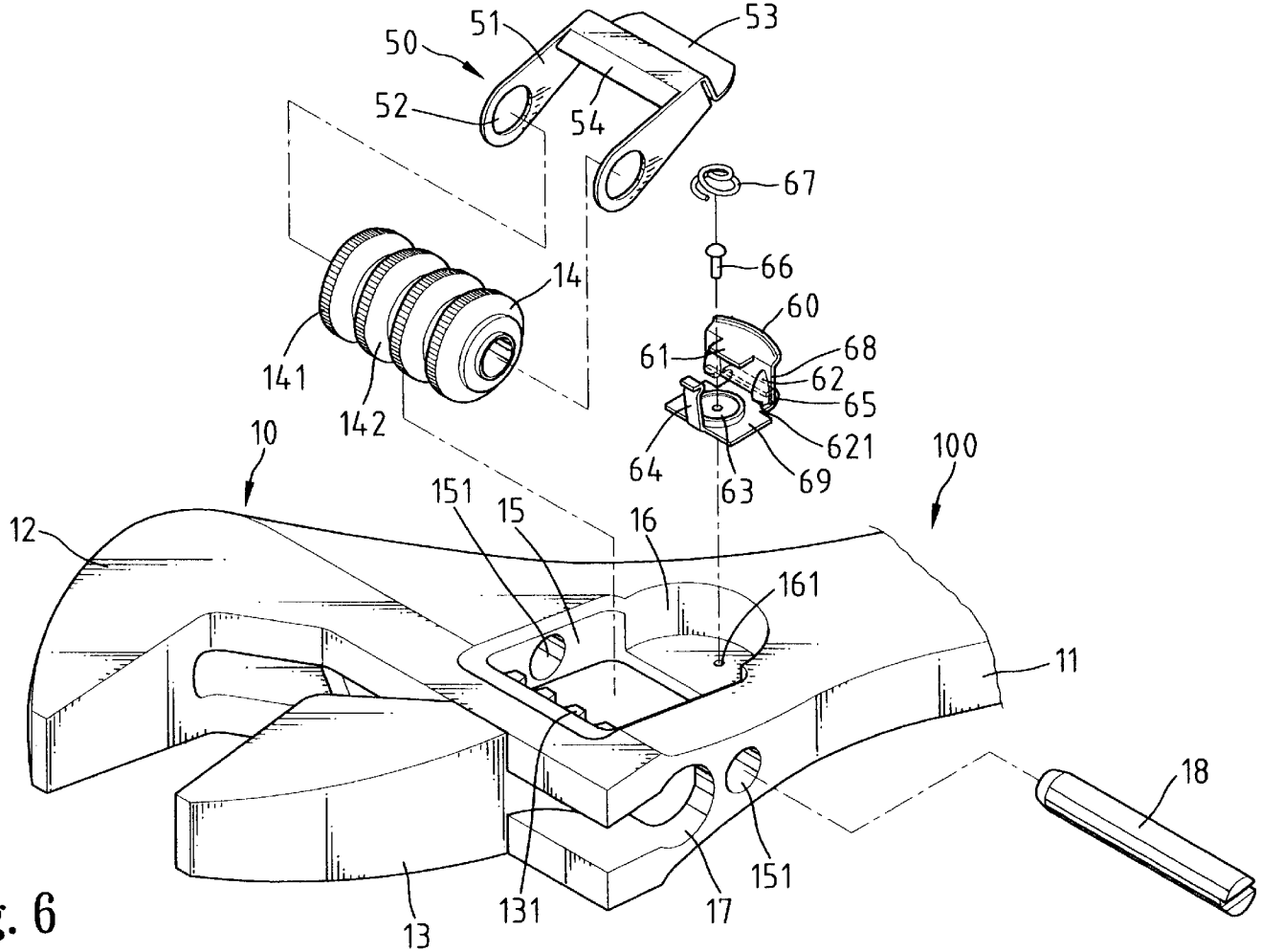
FIG. 6 is an exploded perspective view of the adjustable wrench in FIG. 5.
Figure 7:
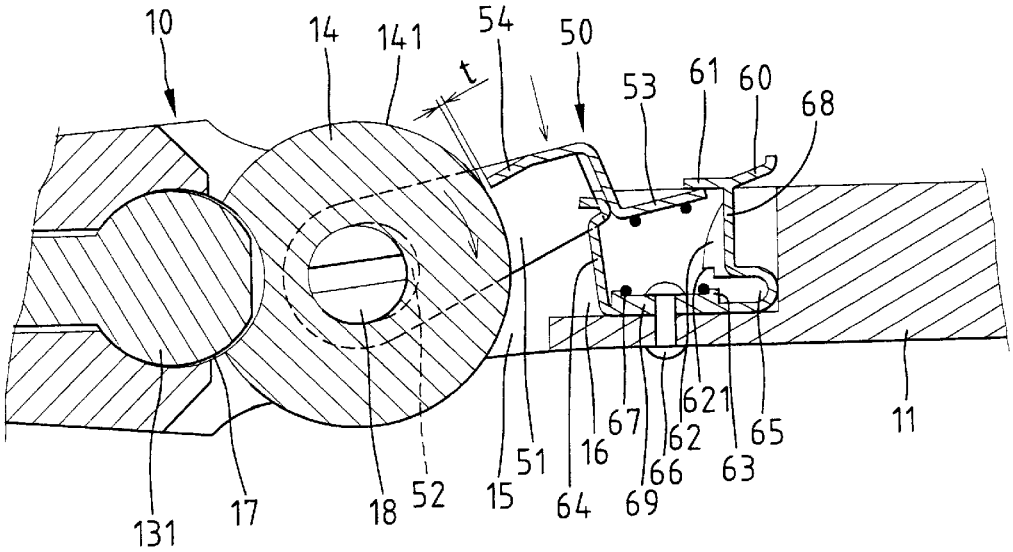
FIG. 7 is a partial sectional view of the adjustable wrench in FIG. 5, wherein an optimal clearance retaining plate is not pressed.

FIGS. 5 to 8 illustrate a second embodiment of the retaining device in accordance with the present invention, wherein like elements are designated by like reference numerals except for the optimal clearance retaining device. In this embodiment, the optimal clearance retaining device includes an actuating member 50, a substantially U-shaped base 60, and an elastic member 67. As shown in FIGS. 6 and 7, the actuating member 50 includes a first open end, two spaced lateral walls 51, and a second end 53. The lateral walls 51 have aligned holes 52 adjacent to the first open end of the actuating member 50 and through which the axle 18 is extended. It is noted that the diameter of the axle 18 is smaller than that that of the hole 52 to allow slight movement of the actuating member 50 relative to the axle 18 and the adjusting screw 14. In addition, a retaining element 54 is provided on the actuating member 50 adjacent to the second end 53.

The U-shaped base 60 includes a first end wall 68 distal to the adjusting screw 14, a second end wall 64 adjacent to the adjusting screw 14, and a mediate section 69. A stop 61 is formed on an upper end of the first end wall 68 for restraining movement of the free end 53 of the actuating member 50. At least one block 62 (two blocks 62 in this embodiment) is formed on the first end wall 68 and faces the second end wall 64. Each block 62 has a notch 621 defined in an underside thereof. The first end wall 68 firer has a cavity 65 to provide the blocks 62 with elasticity. A recess 63 is defined in the mediate section 69 of the base 60 for receiving a lower end of the elastic member 67. An upper end of the elastic member 67 is attached to an underside of the free end 53 of the actuating member 50. A rivet 66 is provided extending through the hold 161 formed in the web area of the head 10 to secure the mediate section 69 of the base 60 in the chamber 16.

Figure 8:
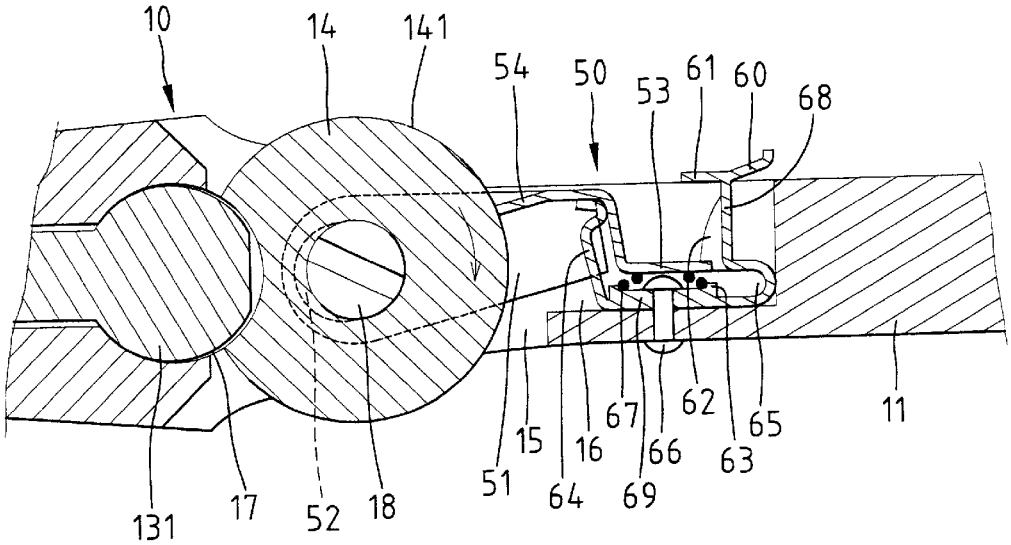
FIG. 8 is a sectional view similar to FIG. 7, wherein the optimal clearance retaining plate is pressed.
Figure 9:
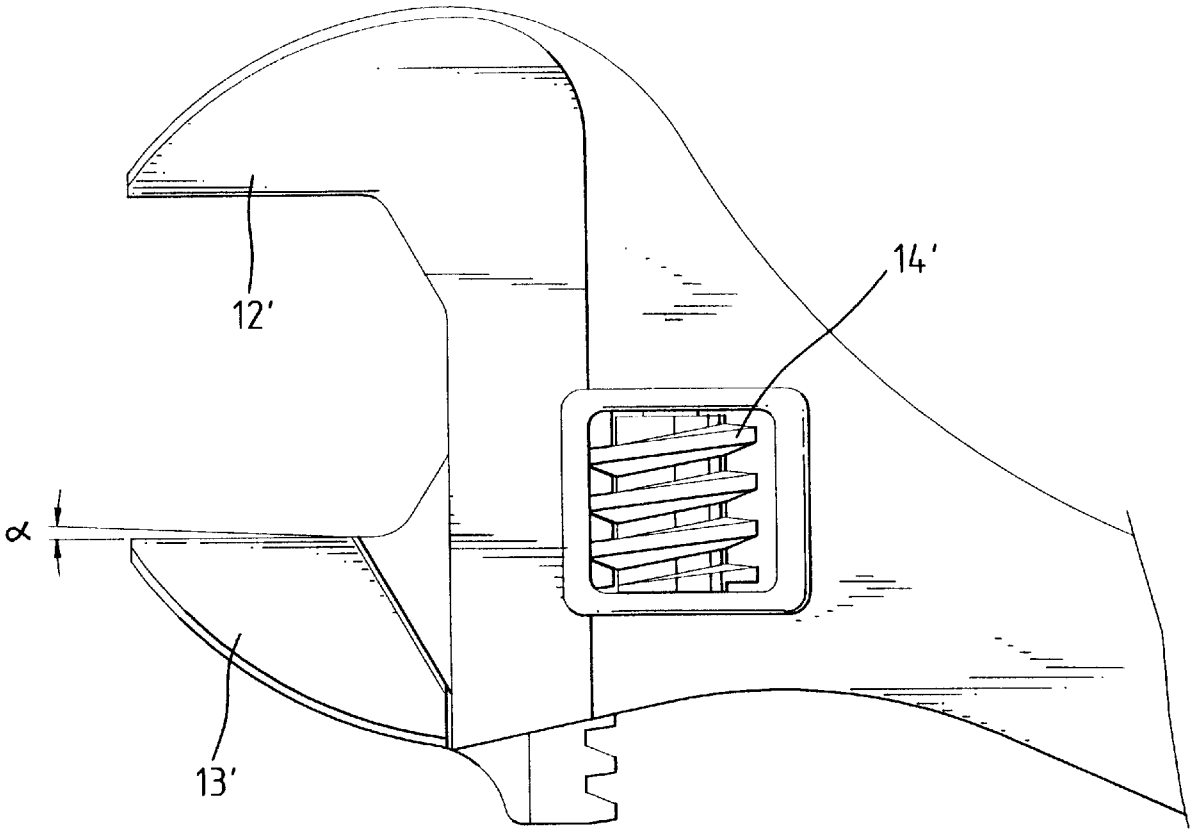
Fig. 9 PRIOR ART
FIG. 9 is a schematic top view of a conventional adjustable wrench.

In use, the user may clamp a nut (not shown) between the fixed jaw 12 and the movable jaw 13 by means of conventional operational procedure before fine adjustment. It is noted that the retaining element 54 has a distance "t" to the adjusting screw 14 so as to not interfere with normal rotation of the adjusting screw 14 before proceeding the fine adjustment, as shown in FIG. 7. If the nut has been tightly clamped between the fixed jaw 12 and the movable jaw 13 (FIG. 7), the user may manually press the retaining element 54 of the actuating member 50 downwardly such that the actuating member 50 moves toward the adjusting screw 14 (since the diameter of the axle 18 is smaller than that of the hole 52). As shown in FIG. 8, the retaining element 54 urges the adjusting screw 14 to rotate in a direction, e.g., clockwise. As a result, the adjusting screw 14 is moved through a pre-determined angle such that the movable jaw 13 is slightly moved away from the fixed jaw 12. As a result, the movable jaw 13 has a pre-determined optimal clearance to the nut. It is appreciated that an end edge of the free end 53 slides along the blocks 62 and is finally retained in the notches 621 of the blocks 62 during the fine adjustment. The cavity 65 allows the blocks 62 to deform. Thus, the adjusting screw 14 is retained in place by the retaining element 54 when in a status shown in FIG. 8. Thus, a reliable optimal clearance can be repeatedly obtained by the adjustable wrench in accordance with the present invention. Such optimal clearance avoids damage to the faces or edges of the nut and allows easy disengagement of the adjustable spanner from the nut. In addition, the optimal clearance can be kept during use of the adjustable wrench. After use, the user may rotate the adjusting screw 14 in a reverse direction to release the adjusting screw 14 from the retaining element 54. The actuating member 50 is returned to its initial free position shown in FIG. 7 under the action of the elastic member 67.

According to the above description, it is appreciated that the adjustable wrenches in accordance with the present invention allow easy, rapid fine adjustment to obtain an optimal clearance for operation, and such fine adjustment can be easily accomplished by a layman. In addition, damage to nuts or the like operated by the adjustable wrench is prevented. Furthermore, the optimal clearance can be repeatedly obtained and reliably retained while allowing easy disengagement of the nuts and the adjustable wrench.

Although the invention has been explained in relation to its preferred embodiment, it is to be understood that many other possible modifications and variations can be made without departing from the spirit and scope of the invention as hereinafter claimed.

What is claimed is:

1. An adjustable wrench comprising, in combination:

a handle;

a head connected to the handle and including a fixed jaw formed thereon and a movable jaw mounted thereon;

an adjusting screw rotatably mounted in a web area between the handle and the head by an axle for moving the movable jaw relative to the fixed jaw upon manual rotational movement of the adjusting screw; and a clearance retaining device including an actuating member having a first end connected to the axle and a second end, and a braking wheel rotatably mounted to the actuating member at a position adjacent to the second end of the actuating member, the braking wheel being movable between a free position spaced from the adjusting screw and a retained position engaged with the adjusting screw, the actuating member being movable between a first position and a second position;

wherein when the actuating member is in the first position and the braking wheel is in the free position, the braking wheel is not engaged with the adjusting screw; and wherein the clearance retaining device further includes means to engage with and rotate the braking wheel through a predetermined rotational angle when the actuating member is manually moved from the first position to the second position wherein said rotation of the braking wheel in turn rotates said adjusting screw when the braking wheel is engaged with the adjusting screw such that the movable jaw is slightly moved away from the fixed jaw for a predetermined distance.

2. The adjustable wrench as claimed in claim 1, wherein the web area includes a chamber defined therein for receiving the clearance retaining device.

3. The adjustable wrench as claimed in claim 1, wherein the adjusting screw includes an anti-skid surface, and the braking wheel includes a braking surface for engaging with the anti-skid surface of the adjusting screw.

4. The adjustable wrench as claimed in claim 1, wherein the first end of the actuating member is open, and the actuating member includes two lateral walls having aligned holes adjacent to the open first end, the axle being extended through the aligned holes in a manner that the adjusting screw is located between the lateral walls of the actuating member.

5. The adjustable wrench as claimed in claim 4, wherein the lateral walls of the actuating member includes aligned holes adjacent to the second end of the actuating member, a pin being extended through the aligned holes, the braking wheel being rotatably mounted around the pin, the pin having a diameter smaller than that of the aligned holes.

6. The adjustable wrench as claimed in claim 1, further comprising an elastic member mounted in the retaining member for biasing the actuating member to the first position.

7. The adjustable wrench as claimed in claim 1, wherein the retaining member includes a first end distal to the adjusting screw, a second end adjacent to the adjusting screw, and a mediate section secured to the web area, and further including an elastic member mounted between the mediate section of the retaining member and the second end of the actuating member for biasing the actuating member to the first position.

8. The adjustable wrench as claimed in claim 7, wherein the actuating member includes aligned holes adjacent to the second end thereof, a pin being extended through the aligned holes, the braking wheel being rotatably mounted around the pin, the pin having a diameter smaller than that of the aligned holes.

9. The adjustable wrench as claimed in claim 7, wherein the first end of the retaining member includes a stop for restraining movement of the second end of the actuating member, thereby retaining the actuating member in the first position.

10. The adjustable wrench as claimed in claim 7, wherein the braking wheel is retained between the second end of the retaining member and the adjusting screw when in the retained position.

11. An adjustable wrench comprising, combination:

a handle;

a head connected to the handle and including a fixed jaw formed thereon and a movable jaw mounted thereon;

an adjusting screw rotatably mounted in a web area between the handle and the head by an axle for moving the movable jaw relative to the fixed jaw upon manual rotational movement of the adjusting screw; and a clearance retaining device including an actuating member, the actuating member having a first end adjacent to the adjusting screw, a second end distal to the adjusting screw, and a retaining element formed adjacent to the second end of the actuating member for releasably retaining the adjusting screw in place, the first end of the actuating member being operably connected to the axle and including a hole through which the axle is extended, with the actuating member being movable between a first free position and a second retained position;

wherein the retaining element is not engaged with the adjusting screw in the first free position and is engaged with the adjusting screw in the second retained position, means to engage with and rotate the retaining element through a predetermined rotational angle when the actuating member is manually moved from the first free position to the second retained position wherein said rotation of the retaining element in turn rotates the adjusting screw when the retaining element is engaged with the adjusting screw such that the movable jaw is slightly moved away from the fixed jaw for a predetermined distance.

12. The adjustable wrench as claimed in claim 11, wherein the web area includes a chamber defined therein for receiving the clearance retaining device.

13. The adjustable wrench as claimed in claim 11, further comprising an elastic member mounted in the base for biasing the retaining element to the first free position.

14. The adjustable wrench as claimed in claim 11, wherein the end wall of the base includes a stop for restraining movement of the second end of the actuating member, thereby retaining the retaining element in the free position.

15. The adjustable wrench as claimed in claim 11 wherein the hole of the actuating member has a diameter greater than that of the axle to allow slight movement of the actuating member relative to the axle and adjusting screw.

16. The adjustable wrench as claimed in claim 11 wherein the clearance retaining device further includes a base mounted to the head and having an end wall with a notch, with the second end of the actuating member being retained in the notch of the base when the actuating member is in the second retained position.

17. The adjustable wrench as claimed in claim 11 wherein the clearance retaining device further includes a base having a stop for restraining movement of the actuating member beyond the first free position, with the base mounted to the head.

18. The adjustable wrench as claimed in claim 11 further comprising, in combination: means for biasing the actuating member from the second retained position to the first free position.

19. The adjustable wrench as claimed in claim 1, wherein the moving means comprises a retaining member mounted to the head and for engaging with and moving the braking wheel from the free position to the retained position as the actuating member is moved from the first position to the second position, with the braking member being retained between the retainer and the adjusting screw when the actuating member is in the second position.

20. The adjustable wrench as claimed in claim 1 further comprising, in combination: means for biasing the actuating member from the second position to the first position.

* * * * *